United States Patent [19]

Lichtgarn

[11] 4,254,835

[45] Mar. 10, 1981

[54] SPRING POWERED ROTARY TOOL

[76] Inventor: Fred Lichtgarn, 314 Evonshire St., Santa Barbara, Calif. 93111

[21] Appl. No.: 947,424

[22] Filed: Oct. 2, 1978

[51] Int. Cl.[3] ..... E21B 3/00; E21B 7/22

[52] U.S. Cl. ..... 173/163; 185/39

[58] Field of Search ..... 173/163; 185/39, 37; 46/39; 408/124

[56] References Cited

U.S. PATENT DOCUMENTS

| | | | |
|---|---|---|---|
| 2,205,083 | 6/1940 | Cazes | 185/39 |
| 2,385,963 | 10/1945 | Beard | 185/39 |
| 3,241,169 | 3/1966 | Windward | 185/39 |
| 3,744,592 | 7/1973 | Neuman | 185/39 |
| 3,859,749 | 1/1975 | Morin et al. | 46/39 |

*Primary Examiner*—Ronald Feldbaum

[57] ABSTRACT

A spring powered rotary hand tool.

5 Claims, 2 Drawing Figures

SPRING POWERED ROTARY TOOL

SUMMARY

This invention relates to small hand-held hobby type rotary tools for which drive small abrasive, cutting and shaping wheels. Such tools are now driven by samll electric high speed motors. This invention discloses a new method of providing spring power to drive such wheels. Electric motors require attached cords and a source of electricity. They are relatively costly to manufacture. Many of the "jobs" for which these tools are used are completed in less than 30 seconds or less. The tool is then laid aside for many minutes until a new use presents itself.

This invention takes all above into account and aims to produce a simple low cost, non-electric rotary hand tool with an integral finger contorolled speed of rotation. This new tool will be powered by a hand wound spring like those found in clocks. This spring will drive several speed step-up gears. An extended shaft from one of these gears will drive and power the various wheels. This power spring will, of course, require periodic rewinding. Other advantages are light weight and the lack of a cord to limit freedom of movement.

DETAILED DESCRIPTION

Figure 2:
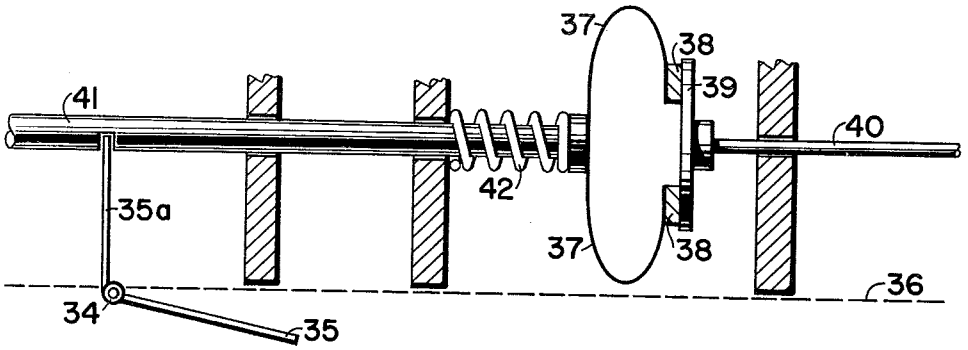
FIG. 2 is a diagrammatic view of another version of a finger controlled speed regulator that has a sensitive regulation capability.
Figure 1:
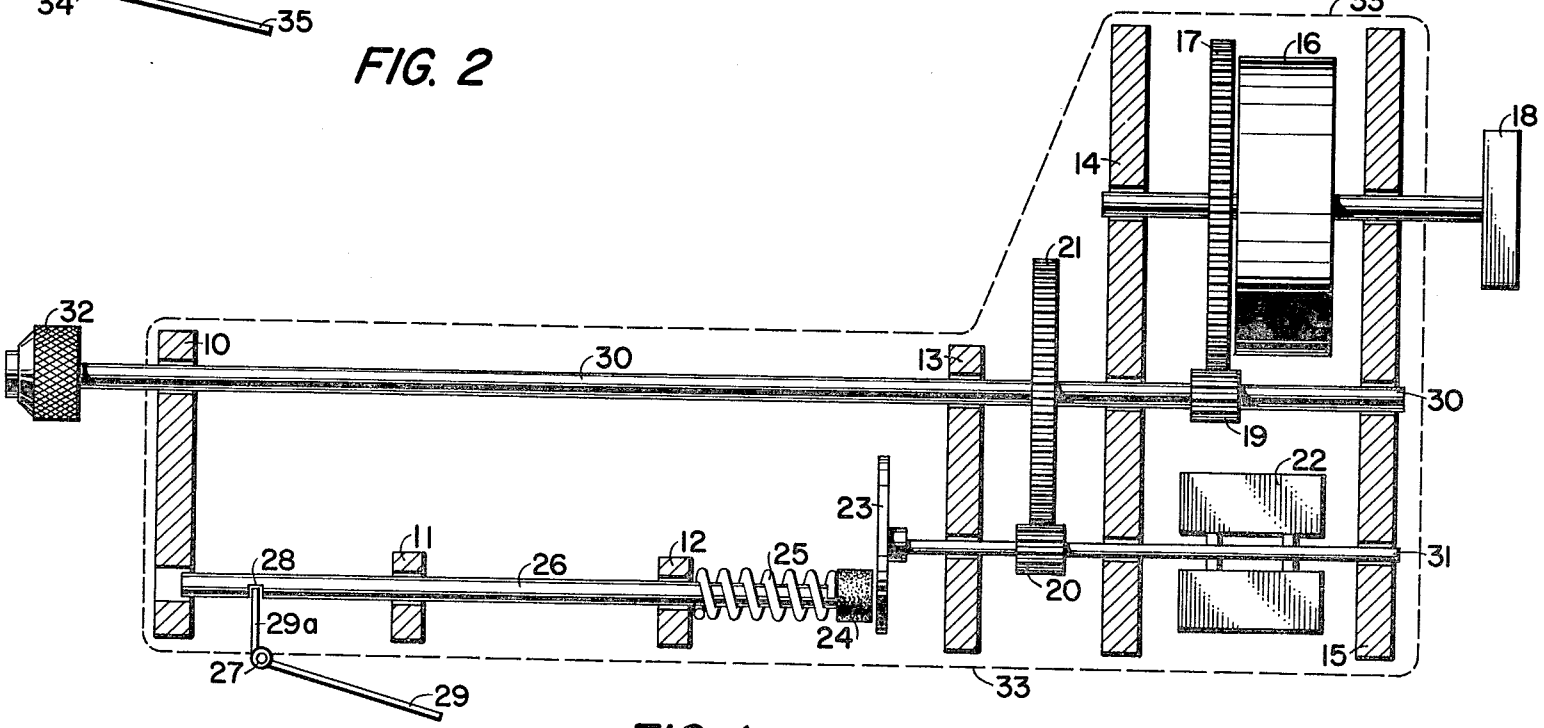
FIG. 1 is a simplified diagrammic view showing the essential parts and incorpating a finger controlled speed regulator.

Referring now to FIG. 1 numbers 10, 11, 12, 13, 14 and 15 represent bearing plates and structural framework. Number 16 is the spring power assembly as found in spring wound alarm clocks. The main power gear 17 is driven by spring 16. Gear 17 drives gear 19 on shaft 30. Gear 21 is solidly attached to shaft 30 and drives gear 20 which is solidly attached to shaft 31. Friction plate 23 is also driven by shaft 31. The friction applied to plate 23 by friction disc 24 and by extension coil spring 25 is enough to keep entire gear train from from going around. If finger pressure is applied to movable actuator 29 and **29*a*, on bearing 27, slideable shaft 26 then moves friction disc 24 away from friction plate 23 thus permitting gear train and chuck 32 to rotate. The more finger pressure that is applied the faster will the gear train and chuck 32 rotate. Remove finger pressure and chuck 32 comes to stop automatically. By proper design of the speed control means along the lines shown here almost any degree of speed control is possible. Lever 29*a* engages a slot 28 in shaft 26. An air paddle 22 can be placed on shaft 26 to thus control to some degree the maximum rotative speed of shaft 26. The dotted line 33 shows the rough outline of this tool. It is of this general shape. The drawing is not to any scale. Many variations of design are possible but all are to achieve the final result that is a finger controlled spring powered rotative hand tool that will require rewinding of the spring power by a key 18. Referring to FIG. 2 shaft 40 is the high speed shaft rotating friction plate 39. Friction discs 38 are attached to springs 37. Springs 37 and spring 42 serve to apply frictional pressure on plate 39 thus preventing shaft 40 from rotating. Finger pressure on lever arm 35 through bearing 34 moves lever 35*a* which in turn causes keyed shaft 41 to move friction discs 38 and thus allow friction plate 39 to rotate. A slight pressure on control lever 35 will slightly reduce disc 38 pressure by allowing springs 37 to very gradually ease their tension. Heavier finger pressure will furthur reduce tension and thus friction plate 39** will rotate faster. Sensitive and quickly responsive speed control is vital to the best operation of a rotary hand tool and is specially applicable to this spring powered device by allowing the wound-up spring power to function longer between rewinds.

This new tool is not meant to supercede the electrically driven tools but to widen the range of usefullness. One important use for this new tool is for the easy, quick and in most cases completely painless removal of "corns" on the human foot. Since it is estimated that one person in 25 have corns the usefullness will become apparent. Because of its light weight and its sensitive speed control and to a lesser extent its lack of a electric cord one can abrade away with perfect control the thickened horny outer part of a corn—with slight pressure applied to the corn. To a large extent my tool wll replace the manually held abrasive sticks which must apply considerable pressure on the corn in order to abrade it. The back and forth motion required also tends to loosen the inner part of the corn causing some pain. In no way can manually applied abrasive means be compared to the relatively high speed one way motion, of low pressure rotary sanders.

Another use for this new tool would be a miniaturized version for powered rotary erasure means for draftsmen. Here the cordless feature would be appreciated. Other uses will suggest themselves or be found when this tool becomes available on the market.

What is claimed is:

1. A spring-powered rotary motion tool comprising:

(a) a housing;

(b) spring-powered rotation means in said housing for providing rotary power;

(c) a gear train driven by said rotation means for progressively stepping-up the speed from said rotation means;

(d) rotation control means cooperatively connected to said gear train for selectively braking same;

(e) a manually operated lever pivotally mounted to said housing and connected to said rotation control means for controlling the same;

(f) a chuck connected to the end of said gear train.

2. A tool as recited in claim 1 wherein said rotation control means comprises:

(a) circular friction plate connected to said gear train;

(b) a slideable shaft connected to said lever;

(c) a friction disc placed at one end of said slideable shaft;

(d) spring means for pressing said friction disc against said friction plate.

3. A tool as recited in claim 2 wherein said spring-powered rotation means comprises:

(a) a spiral spring connected to said gear train;

(b) a manually turnable key to wind said spiral spring.

4. A tool as recited in claim 1 wherein said housing comprises at least one support member to firmly hold in position said gear train.

5. A tool as recited in claim 1 further comprising an air paddle connected to said gear train to limit the rotation speed of said gear train.

* * * * *